US008749450B2

(12) United States Patent
He

(10) Patent No.: US 8,749,450 B2
(45) Date of Patent: Jun. 10, 2014

(54) ANTENNA BRACKET WITH ADJUSTING FUNCTION

(75) Inventor: Xiao-Lian He, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 215 days.

(21) Appl. No.: 13/405,371

(22) Filed: Feb. 27, 2012

(65) Prior Publication Data

US 2012/0325997 A1 Dec. 27, 2012

(30) Foreign Application Priority Data

Jun. 22, 2011 (CN) ..... 2011 1 0169035

(51) Int. Cl.
*H01Q 1/12* (2006.01)

(52) U.S. Cl.
USPC ..... 343/892; 343/878; 343/880; 343/882; 248/285.1; 52/726.1

(58) Field of Classification Search
USPC ..... 343/878, 880, 882, 890, 891, 892; 248/285.1, 346.03; 52/726.1, 726.3
See application file for complete search history.

(56) References Cited

U.S. PATENT DOCUMENTS

| | | | | |
|---|---|---|---|---|
| 4,748,451 | A * | 5/1988 | Edwards | 343/880 |
| 5,787,673 | A * | 8/1998 | Noble | 52/848 |
| 6,211,845 | B1 * | 4/2001 | Cook et al. | 343/882 |
| 6,222,504 | B1 * | 4/2001 | Oby | 343/892 |
| 6,232,928 | B1 * | 5/2001 | Zimmerman et al. | 343/882 |
| 6,361,007 | B1 * | 3/2002 | Oby et al. | 248/285.1 |
| 8,505,867 | B2 * | 8/2013 | Conrad | 248/431 |
| 2013/0335294 | A1 * | 12/2013 | He | 343/880 |

FOREIGN PATENT DOCUMENTS

| | | |
|---|---|---|
| CN | 201332135 Y | 10/2009 |
| CN | 201608267 U | 10/2010 |

OTHER PUBLICATIONS

Baudry, D.; Bicrel, F.; Bouchelouk, L.; Louis, A.; Mazari, B.; Eudeline, P., Near-field techniques for detecting EMI sources, Aug. 9-13, 2004, 11-13 page(s) vol. 1, 0-7803-8443-1, Electromagnetic Compatibility, 2004. EMC 2004. 2004 InternationalSymposium on (vol. 1).

* cited by examiner

*Primary Examiner* — Tho G Phan
(74) *Attorney, Agent, or Firm* — Novak Druce Connolly Bove + Quigg LLP

(57) ABSTRACT

An antenna bracket includes two substrates having a bottom surface and a supporting surface; a plurality of movable rollers installed on the bottom; two columns, respectively set up on the supporting surface of the substrates; a beam with two ends movably connected with the two columns; two first driving members, fixed on each supporting surface and connected with the beam to drive the beam to slide upward and downward relative to the two columns; an antenna base, movably connected with the beam to install an antenna; a second driving member, fixed on the beam and connected with the antenna base, to drive the antenna base to slide horizontally; two first electromagnetic shield covers and a second electromagnetic shield cover respectively covering the two first driving members and the one second driving member, to attenuate electromagnetic interference (EMI) emanation from openings in the first driving members and the second driving member.

19 Claims, 4 Drawing Sheets

ANTENNA BRACKET WITH ADJUSTING FUNCTION

BACKGROUND

1. Technical Field

The present invention relates to antenna brackets, and more particularly to an antenna bracket capable of adjusting position easily.

2. Description of Related Art

Objects to be tested for electromagnetic interference are often put on a rotary table, and an antenna is placed beside the objects to receive any electromagnetic interference signals.

However, if an object to be tested is quite large, the rotary table may be not large enough, and to place the antenna on the rotary table is difficult.

BRIEF DESCRIPTION OF THE DRAWINGS

Many aspects of the present embodiments can be better understood with reference to the drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Embodiments of the present disclosure will be described with reference to the accompanying drawings.

Figure 1:
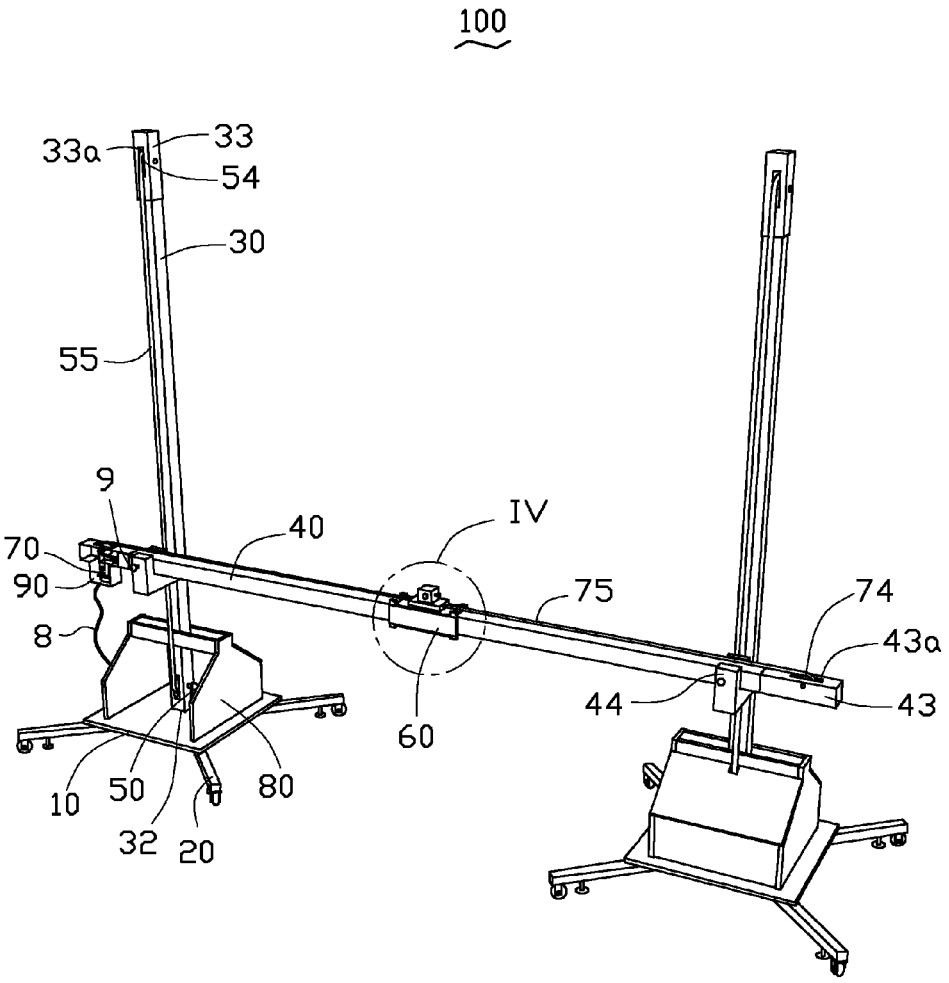
FIG. 1 is an isometric view of an embodiment of an antenna bracket from one view angle.
Figure 2:
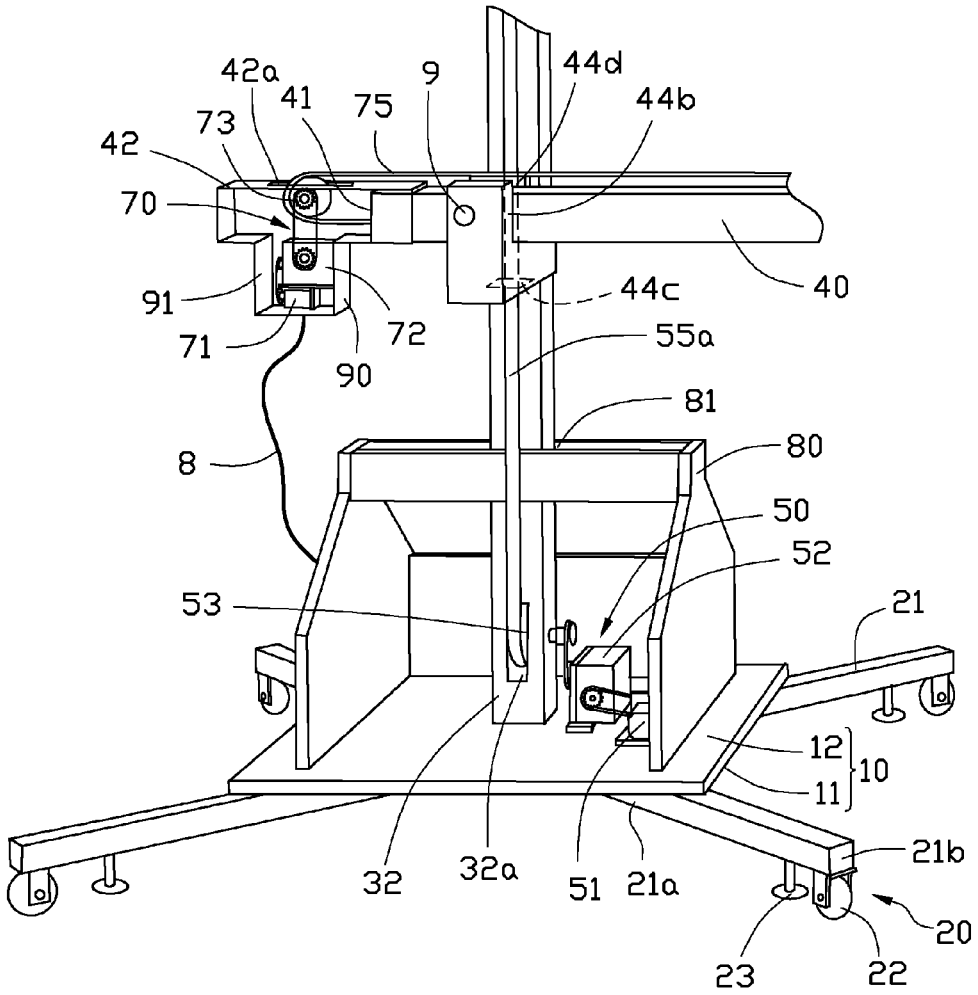
FIG. 2 is an enlarged view of an part of the antenna bracket of FIG. 1.
Figure 3:
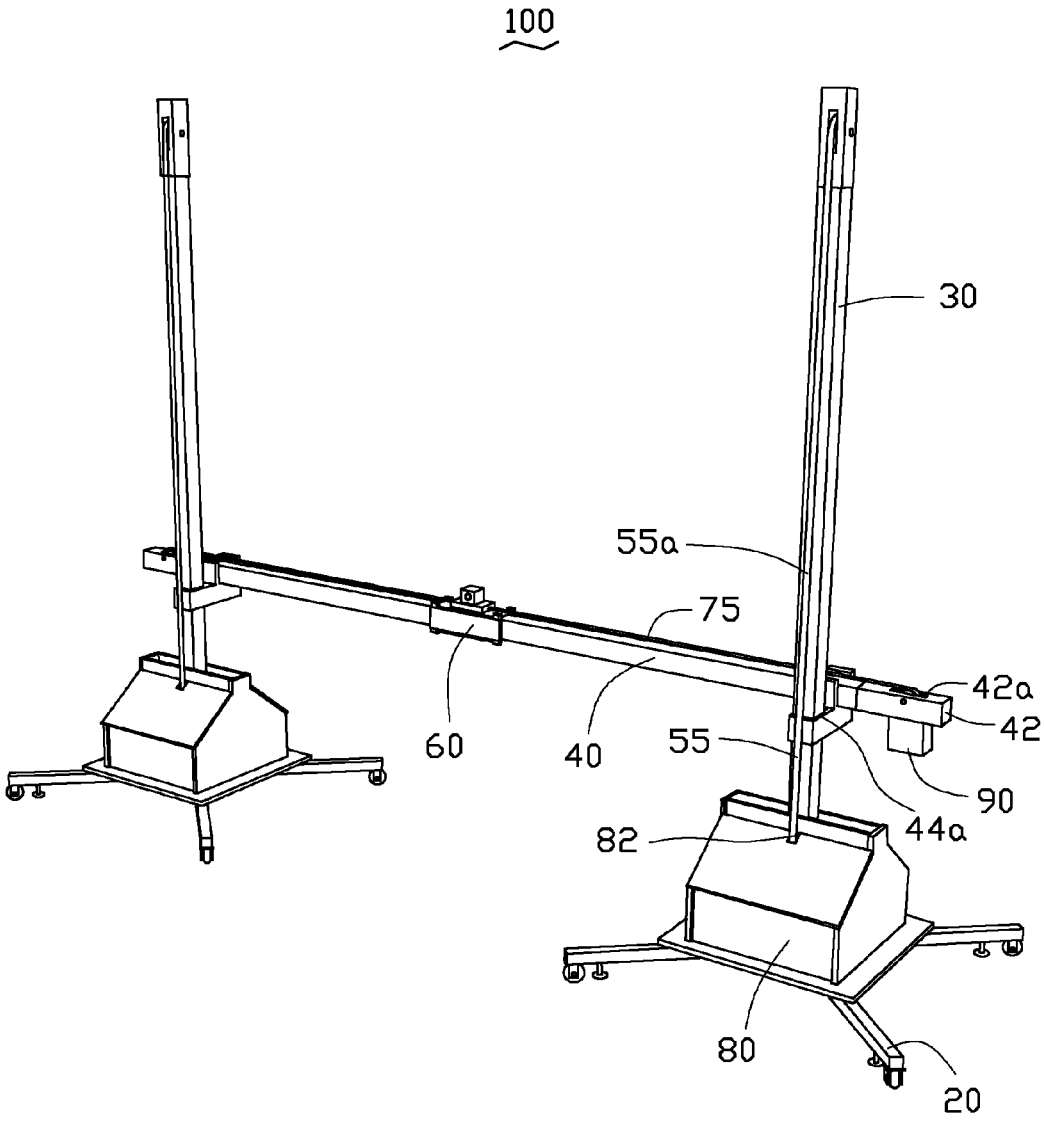
FIG. 3 is another isometric view of an embodiment of the antenna bracket of FIG. 1 from another view angle.

In FIGS. 1-3, the antenna bracket 100 includes two substrates 10, two legs 20, two columns 30, a beam 40, two first driving members 50, an antenna base 60, a second driving member 70, two first electromagnetic shield covers 80, and a second electromagnetic shield cover 90.

The two substrates 10 can be in one piece. The two substrates 10 have similar constructions. The substrate 10 includes a bottom surface 11 and a supporting surface 12 opposite to the bottom surface 11. The two legs 20 are fixed on the bottom surface 11 of the two substrate 10. The two legs 20 have a similar construction. The leg 20 has four leg poles 21 and four standing feet 23. One end of each of the four leg poles 21 are connected together to form a cross. The other end of each of the four leg poles 21 has a movable roller 22 and the standing foot 23. Four of the movable rollers 22 are used to move the antenna bracket 100. Four of the standing feet 23 are mounted on an inner surface of the movable rollers 22. The four standing feet 23 are screw-adjustable for fixing and adjusting the substrate 10.

The two columns 30 are respectively set up on each of the supporting surface 12 of the two substrates 10. The two columns 30 may each be quadrangular prism. The column 30 has a first end 32 and a second end 33. The first end 32 is fixed on the supporting surface 12 of the substrate 10. The first end 32 has a first sprocket hole 32*a*. The second end 33 has a second sprocket hole 33*a*.

The two ends of the beam 40 are movably connected with the two columns 30. The two beams 40 are hollow and have inner cavities. The beam 40 has a third end 42 and a fourth end 43 opposite to the third end 42. The third end 42 and the fourth end 43 of the beam 40 are movably connected with the two columns 30 via a beam support 44. The beam support 44 includes a sliding hole 44*a*, a supporting part 44*b*, and a first groove 44*c*. The beam support 44 is F-shaped. The sliding hole 44*a* and the column 30 are movably connected together. The supporting part 44*b* further has an upper opening 44*d*. The third end 42 and the fourth end 43 of the beam 40 are mounted in the opening 44*d*, and fixed via a screw 9. The first groove 44*c* is mounted between the sliding hole 44*a* and the supporting part 44*b*, and extends along the direction of the column 30. The third end 42 has a third sprocket hole 42*a* connected with the inner cavity 41. The fourth end 43 has a fourth sprocket hole 43*a* connected with the inner cavity 41.

The two first driving members 50 are connected with the beam 40, and respectively fixed on each of the supporting surfaces 12 of the two substrates 10, for driving the beam 40 to slide upward and downward relative to the two columns. The two first driving members 50 have similar constructions. The first driving member 50 includes a first motor 51, a first gearbox 52, a first driving gear 53, a first driven gear 54, and a first synchronous loop 55. The first motor 51 and the first gearbox 52 are fixed on the supporting surface 12, and the motion(s) thereof are transmitted by belt. The first driving gear 53 is on the first end 32 of the column 30 and installed in the first sprocket hole 32*a*. The first gearbox 52 and the first driving gear 53 are driven by belt. The first driving gear 54 is on the second end 33 of the column 30 and installed in the second sprocket hole 33*a*. The first driving gear 53 and the first driven gear 54 are driven by the first synchronous loop 55. The first synchronous loop 55 extends through the first sprocket hole 32*a* and second sprocket hole 33*a*. The beam support 44 is fixed on a first surface part 55*a* of the first synchronous loop 55. The first synchronous loop 55 extends through the first groove 44*c* and is fixed by screw. When the first motor 51 rotates, the first synchronous loop 55 can drive the beam support 44 to slide the beam 40 upward and downward.

The second driving member 70 is fixed on the third end 42 of the beam 40. The second driving member 70 is connected with the antenna base 60, and drives the antenna base 60 to shift horizontally. The second driving member 70 includes a second motor 71, a second gearbox 72, a second driving gear 73, a second driven gear 74, and a second synchronous loop 75. The second motor 71 and the second gearbox 72 are fixed on the third end 42 of the beam 40, and connected by belt. The second driving gear 73 is installed in the third end 42 of the beam 40. The second gearbox 72 and the second driving gear 73 are driven by belt. The second driven gear 74 is installed in the fourth end 43 of the beam 40. The second driving gear 73 and the second driven gear 74 are driven by the second synchronous loop 75. The second synchronous loop 75 extends through the third sprocket hole 42*a*, the inner cavity 41, and the fourth sprocket hole 43*a*. The antenna base 60 is fixed on a second surface part 75*a* of the second synchronous loop 75. The second synchronous loop 75 extends through the second groove 62*c* and is fixed by screw. When the second motor 71 rotates, the second synchronous loop 75 moves the antenna base 60 along the beam 40, thereby achieving horizontal movement of the antenna base 60.

The two first electromagnetic shield covers 80 are respectively fixed on the two supporting surfaces 12 of the two substrates 10. The first electromagnetic shield cover 80 is made of electromagnetic shielding material. The first electromagnetic shield cover 80 is fixed on the supporting surface 12, and covering the first driving member 50. The first electromagnetic shield cover 80 is used to attenuate electromagnetic interference (EMI) emanating from openings in the first driving member 50. The top of the first electromagnetic shield cover 80 defines a first through hole 81 and a second through hole 82. The column 30 extends through the first through hole 81. The first synchronous loop 55 extends through the second through hole 82.

The second electromagnetic shield cover 90 is made of electromagnetic shielding material. The second electromagnetic shield cover 90 is fixed on the third end 42 of the beam 40, and covering the second driving member 70. The second electromagnetic shield cover 90 is used to attenuate electromagnetic interference(EMI) emanating from openings in the second driving member 70. The second motor 71 and the second gearbox 72 are fixed on an inner surface 91 of the second electromagnetic shield cover 9. Power is transmitted between the first electromagnetic shield cover 80 and the second electromagnetic shield cover 90 by a crimp wire 8.

Figure 4:
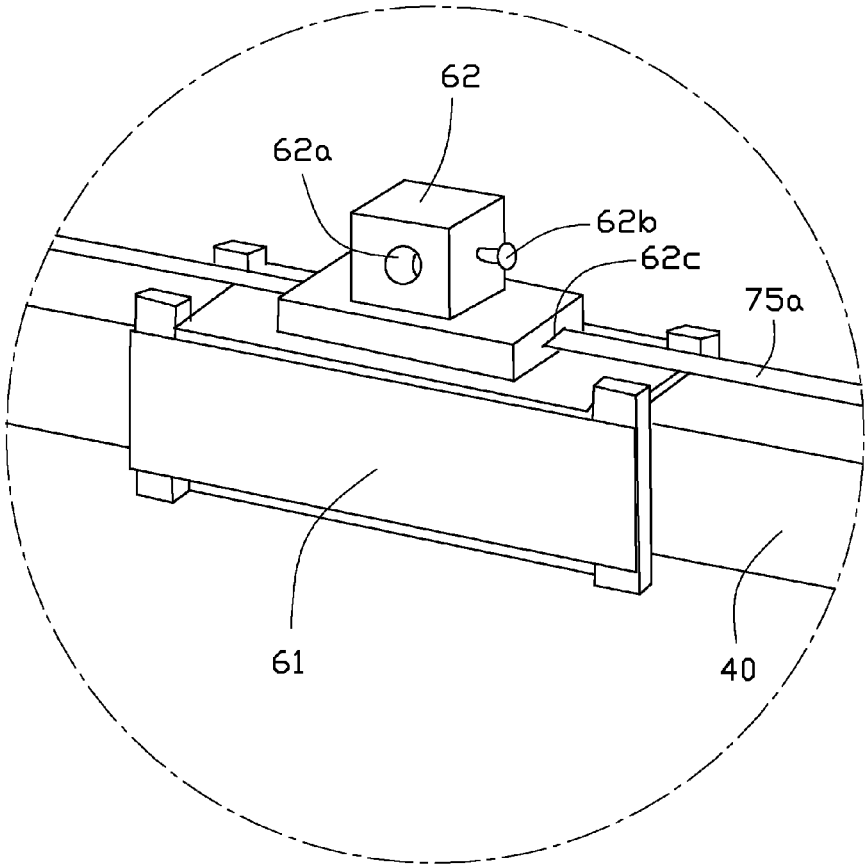
FIG. 4 is an enlarged view of IV of FIG. 1.

In FIG. 4, the antenna base 60 is movably connected with the beam 40 to install the antenna. The antenna base 60 includes a guide bush 61 and a connection part 62. The guide bush 61 is movably connected with the beam 40. The connection part 62 is fixed on the guide bush 61. The connection part 62 is used to connect antenna. The connection part 62 includes a connection hole 62*a*, a locking screw 62*b*, and a second groove 62*c*. The second groove 62*c* is mounted below the connection hole 62*a*, and extends along the beam 40. The locking screw 62*b* is installed laterally on the connection part 62, and goes into the connection hole 62*a*. When the antenna is installed, a fixing end of the antenna is installed in the connection hole 62*a*, and then the locking screw 62*b* is used to secure the antenna.

The antenna bracket 100 can be controlled manually or automatically. When the antenna bracket 100 is automatically controlled, the movement of the column 30 and the beam 40 are restricted by limit switches.

The antenna bracket 100 in the present disclosure provides the antenna base 60 to install an antenna, adjust the movement and orientation of the antenna bracket 100 by the movable roller 22, and makes the antenna slide up or down or horizontally by the sliding of the beam 40 and the antenna base 60.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An antenna bracket comprising:

two substrates each of which has a bottom surface and a supporting surface opposite to the bottom surface;

a plurality of movable rollers, installed on the bottom surface of the substrates, to move the antenna bracket;

two columns, respectively set up on the supporting surface of the substrates;

a beam with two ends movably connected with the two columns;

two first driving members, respectively fixed on each supporting surface and connected with the beam to drive the beam to slide upward and downward relative to the two columns;

an antenna base, movably connected with the beam to install an antenna;

a second driving member, fixed on the beam and connected with the antenna base, to drive the antenna base to slide horizontally;

two first electromagnetic shield covers, respectively fixed on each supporting surface and covering the first driving member, to attenuate electromagnetic interference (EMI) emanation from openings in the first driving member; and a second electromagnetic shield cover, fixed on the beam and covering in the second driving member, to attenuate EMI emanation from openings in the second driving member.

2. The antenna bracket of claim 1, further comprising two legs fixed on each of the bottom surface of the two substrates, wherein the leg has four leg poles and four standing feet, one ends of the four leg pole are connected together to form a cross, all another ends of the four leg pole are installed a movable roller and a standing feet.

3. The antenna bracket of claim 2, wherein four of the movable rollers are used to move the antenna bracket, and four of the standing feet are mounted on an inner surface of the movable rollers.

4. The antenna bracket of claim 3, wherein the four standing feet are screw-adjustable for fixing and adjusting the substrate.

5. The antenna bracket of claim 1, wherein the column has a first end and a second end, the first end is fixed on the supporting surface of the substrate, the first end has a first sprocket hole, the second end has a second sprocket hole.

6. The antenna bracket of claim 5, wherein the beam has a third end and a fourth end opposite to the third end, the third end and the fourth end of the beam are movably connected with the two columns via a beam support.

7. The antenna bracket of claim 6, wherein the beam support further comprises a sliding hole, a supporting part, and a first groove, the sliding hole and the column are movably connected together, the supporting part has an upper opening, the third end and the fourth end of the beam are mounted in the upper opening, and fixed via a screw, the first groove is mounted between the sliding hole and the supporting part, and extends along the direction of the column.

8. The antenna bracket of claim 7, wherein two beams are hollow and have inner cavities, the third end has a third sprocket hole connected with the inner cavity, the fourth end has a fourth sprocket hole connected with the inner cavity.

9. The antenna bracket of claim 8, wherein each of the first driving member further comprises a first motor, a first gearbox, a first driving gear, and a first synchronous loop, the first motor and the first gearbox are fixed on the supporting surface and transmitted by belt, the first driving gear is on the first end of the column and installed in the first sprocket hole, the first gearbox and the first driving gear are driven by belt, the first driving gear is on the second end of the column and installed in the second sprocket hole, the first driving gear and the first driven gear are driven by the first synchronous loop, the first synchronous loop extends the first sprocket hole and second sprocket hole, the beam support is fixed on a first surface part of the first synchronous loop, the first synchronous loop extends the first groove and fixed by screw, when the first motor rotates, the first synchronous loop drives the beam support to slide on the column to move the beam upward and downward relative to the two columns.

10. The antenna bracket of claim 9, wherein the second driving member further comprises a second motor, a second gearbox, a second driving gear, a second driven gear and a second synchronous loop, the second motor and the second gearbox are fixed on the third end of the beam, and connected by belt, the second driving gear is installed in the third end of the beam, the second gearbox and the second driving gear are driven by belt, the second driven gear is installed in the fourth end of the beam, the second driving gear and the second driven gear are driven by the second synchronous loop, the second synchronous loop extends the third sprocket hole, the inner cavity and the fourth sprocket hole, the antenna base is fixed on a second surface part of the second synchronous loop, the second synchronous loop extends the second groove and fixed by screw, when the second motor rotates, the second synchronous loop drives the antenna base to move along the beam, thereby driving the antenna base to shift horizontally.

11. The antenna bracket of claim 10, wherein the antenna base further comprises a guide bush and a connection part, the guide bush is movably connected with the beam, the connection part is fixed on the guide bush, the connection part is used to connect antenna.

12. The antenna bracket of claim 11, wherein the connection part further comprises a connection hole, a locking screw, and a second groove, the second groove is mounted below the connection hole, and extends along the beam, the locking screw is installed on lateral of the connection part, and goes into the connection hole, when the antenna is installed, a fixing end of the antenna is installed in the connection hole, and then the locking screw is used to fix the antenna.

13. The antenna bracket of claim 12, wherein the top of the first electromagnetic shield cover defines a first through hole and a second through hole, the column extends through the first through hole, and the first synchronous loop extends through the second through hole.

14. The antenna bracket of claim 13, wherein the second motor and the second gearbox are fixed on an inner surface of the second electromagnetic shield cover, the first electromagnetic shield cover and the second electromagnetic shield cover transmit power by a crimp wire.

15. The antenna bracket of claim 1, wherein the beam support is F-shaped.

16. The antenna bracket of claim 1, wherein the first electromagnetic shield cover is made of electromagnetic shielding material.

17. The antenna bracket of claim 1, wherein the second electromagnetic shield cover is made of electromagnetic shielding material.

18. The antenna bracket of claim 1, wherein the two columns are quadrangular prism.

19. The antenna bracket of claim 18, wherein when the antenna bracket is automatically controlled, the movement of the column and the beam is restricted by limit switches.

* * * * *